United States Patent [19]

Smith

[11] 4,417,361

[45] Nov. 29, 1983

[54] GRAB BAR

[75] Inventor: Alfred A. Smith, Van Nuys, Calif.

[73] Assignee: Guardian Products Company, Inc., North Hollywood, Calif.

[21] Appl. No.: 379,253

[22] Filed: May 17, 1982

[51] Int. Cl.[3] ..... A47K 3/022

[52] U.S. Cl. ..... 4/577; 294/16; 294/103 R

[58] Field of Search ..... 4/576, 577, 511, 611; 269/3; 294/16, 103 R

[56] References Cited

U.S. PATENT DOCUMENTS

| | | | |
|---|---|---|---|
| 2,513,619 | 7/1950 | Bennett | 4/577 |
| 3,414,909 | 12/1968 | Provi et al. | 4/577 |
| 3,448,468 | 6/1969 | Murcott | 4/577 |
| 3,968,524 | 7/1976 | Zentman | 4/577 |

FOREIGN PATENT DOCUMENTS

| | | | |
|---|---|---|---|
| 810914 | 3/1959 | United Kingdom | 4/577 |

*Primary Examiner*—Charles E. Phillips

*Attorney, Agent, or Firm*—Beehler, Pavitt, Siegement, Jagger & Martella

[57] ABSTRACT

Gripping means to provide hand support for a person stepping over a wall, such as the side wall of a bathtub, comprising a rigid corner plate fitting over and extending down the outer edge of the wall, to the top of which plate is secured a hollow member closed at its front end and extending transversely across the wall rim to support handle means extending upwardly from the hollow member. A slidable member is provided within the hollow member, said slidable member having axially extending female threading to receive a threaded element. Such an element is provided to enter through an orifice in the closed front end of the hollow member, and is capped at its outer end with a torquing knob. The distal end of the slidable member carries a downwardly projecting clamping member having pivotable plate means in facing engagement with the inside of the wall to enable the wall to be clamped between such plate means and the rigid plate, thereby to provide firm support for the upwardly extending handle means.

4 Claims, 6 Drawing Figures

GRAB BAR

FIELD OF THE INVENTION

This invention relates to household devices and specifically to one intended principally for use in a bathroom to provide secure hand support to a person who may need such support in attempting to enter or leave a bathtub.

DESCRIPTION OF THE PRIOR ART

The broad idea of providing some type of hand support for a person entering or leaving a bathtub admittedly is not novel. The closest prior art of which the present inventor is aware is an item called a "bathtub safety rail," manufactured by Jung Products, Inc., 5801 Mariemont Avenue, Cincinnati, Ohio 45227. The construction of this item is illustrated in FIGS. 1 and 2 of the drawings. Other different types of bathtub rails may be found illustrated in the 1980 Catalog Sheet No. 6 of Sickroom Service, Inc. of Milwaukee, Wis.

While these prior art bathtub safety rails may be found to provide a type of hand support for a person entering a bathtub, some of the actual gripping rails are low in height, thereby forcing the user to bend over in order to grip the rail and obtain the desired support. In addition, some prior art safety rails present a number of sharp corners at both ends of the rails against any of which the user may undesirably come into contact with some part of his or her leg. In addition, because most of the prior art rails are disposed in the direction of the bathtub wall, they require the user to rotate his or her grip on the rail upon entering the tub, instead of being able to grip securely and track the stepping into the tub by the user's arm movement, as would be possible if the gripping handle were disposed transversely of the tub wall.

A principal problem with most prior art bathtub rails has been in the particular means which have been employed to clamp the bases of the rails to the bathtub wall. In most instances other than that illustrated in the drawings, such clamping has been accomplished by the drawing action of screws which have been tightened by means of a screwdriver or wrench. This has not only required the availability of such tools but, in using such tools, there is always the danger of the installer tightening the screws to the point where the tub wall may become cracked or chipped.

In addition, because some of the prior art safety rails are designed to grip the tub wall in two places, twice as many parts are required, as would be with a rail or grip bar which could be secured by a single clamping action. Thus, the prior art devices are more costly to manufacture and, in the end, to the consuming user.

DESCRIPTION OF THE PRESENT INVENTION

The present invention obviates the foregoing criticisms of the prior art device by providing a rail or grip bar transversely of the tub wall instead of in alignment therewith, and presenting a much higher disposed hand grip. Support for this bar is provided by a rigid rectangular corner plate, bent at a ninety degree angle to dispose one portion on the top of the tub wall and the remaining portion in facing engagement with the outside of the tub wall. The latter portion may be reinforced by a pair of diverging stiffening elements which are commonly connected to a hollow member, closed at its front end, extending transversely across the rim of the tub wall, and secured to the top of the corner plate centrally thereof. A slidable member is provided within this hollow member, the forward end of which slidable member includes an axially threaded portion to receive a threaded element which enters such axially threaded portion through an orifice in the closed front end of the hollow member. The outer end of this threaded element is provided with a torquing knob which turns against the closed but orificed end of the hollow member thereby to move the slidable member axially relative to the hollow member. The distal end of the slidable member carries a vertically downwardly extending clamping element having a pivotable clamping plate disposable in facing engagement with the inside wall of the tub.

It may be seen that the present invention enables the upwardly extending grab rail to be effectively clamped securely to the tub wall. Because of its heighth and transverse orientation to the tub wall, the user may readily grasp the top of the rail and, without rotating his or her grip or the necessity of bending over until after entry into the tub has been completed, simply step into the tub.

Moreover, since only a single clamp is required, the grab rail of the present invention may be manufactured and sold more inexpensively than prior art devices.

BRIEF DESCRIPTION OF THE DRAWINGS

In the accompanying drawings.

DESCRIPTION OF THE PREFERRED EMBODIMENT OF THE INVENTION

Figure 1:
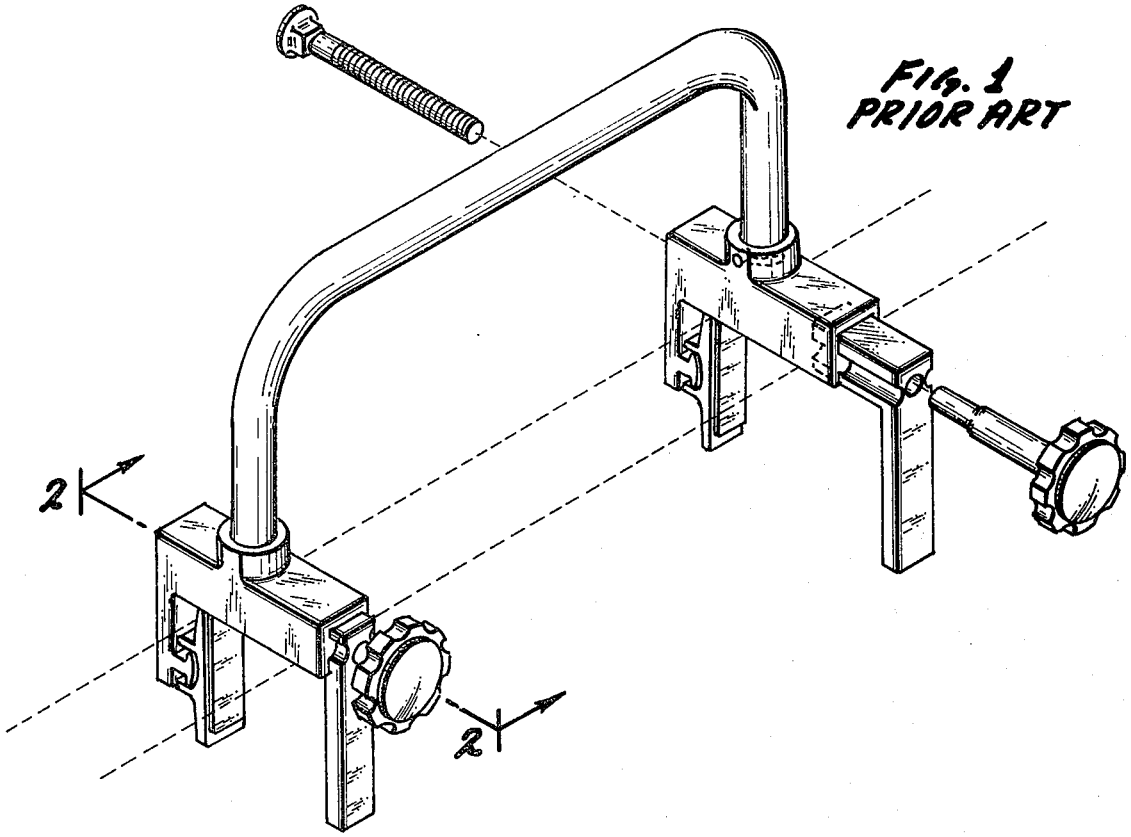
FIG. 1 PRIOR ART
FIG. 1 is a perspective view of a prior art bathtub rail.
Figure 2:
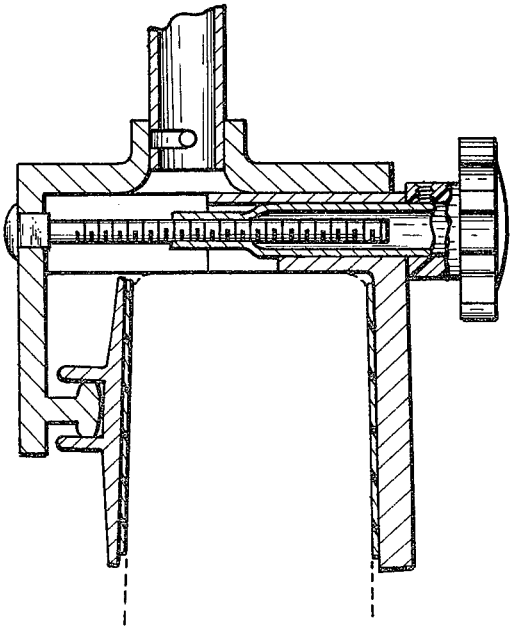
FIG. 2 PRIOR ART
FIG. 2 is a section taken on the line 2—2 in FIG. 1.
Figure 3:
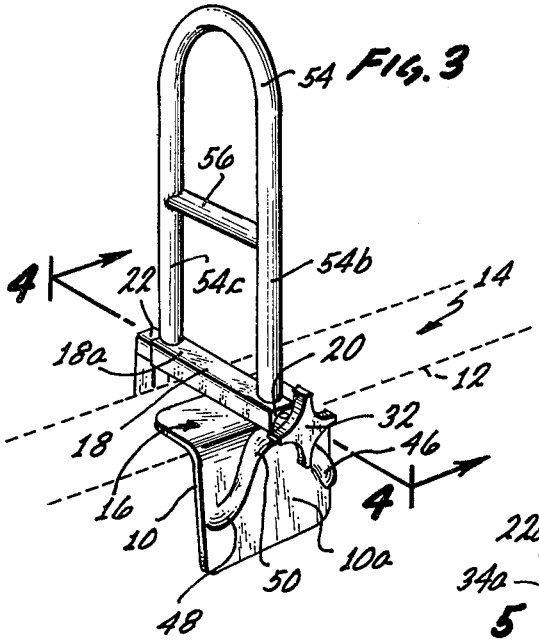
FIG. 3 is a perspective view of the grab bar of the present invention taken from outside of the bathtub wall shown in dotted lines.
Figure 4:
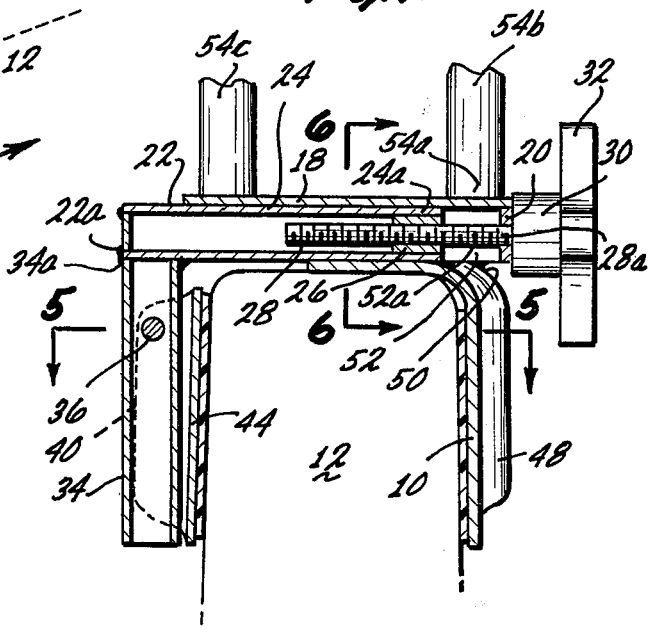
FIG. 4 is a section taken on the line 4—4 of FIG. 3.

Referring to FIG. 3 of the drawings, 10 is a rigid angle plate which may be disposed at any convenient spot along the outside edge 12 of the tub wall 14 shown in dotted lines. Secured centrally across the top portion 16 of the angle plate 10 to extend transversely of the tub wall 14 is a hollow member, preferably square in cross section. This member 18 is closed at its forwardly projecting end 20 and open at its opposite end 22. As best shown in FIG. 4, an inner hollow member 24, conforming externally to the configuration of the hollow interior of the member 18, is provided for slidable movement coaxially within such member 18. The forward end **24*a* of the inner slidable member 24 includes a nut or threaded portion 26 which serves to receive a mating threaded element 28. A coaxial collar 30 and a torquing knob 32 are disposed on the forward end of the threaded element 28. The collar 30 is in facing engagement with the closed front end 20 of the hollow bar member 18**, and desirably may be fabricated of teflon or some other inherently lubricated plastic.

Extending downwardly from, and fixedly secured to, the innermost end **22*a* of the inner slidable member 24 is a downwardly extending clamp support member 34 which is preferably hollow and of a square cross section. The upper end 34*a* of the member 34 may be welded or otherwise well secured to the end 22***a* of the slidable member 24. To provide an effective clamping action upon the wall 12 of the bathtub, which wall may be tapered slightly from bottom to top, the downwardly extending member 34 may be transversely orificed at 36 to permit the passage therethrough of a bolt 38 which is also passed through a pair of trunnions 42 extending rearwardly from a clamping plate 34. These trunnions may be asymmetrically orificed as best shown in FIG. 4.

Figure 5:
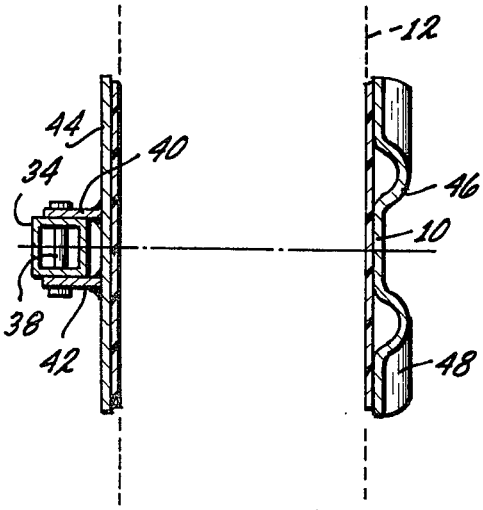
FIG. 5 is a section taken on a line 5—5 of FIG. 4.
Figure 6:
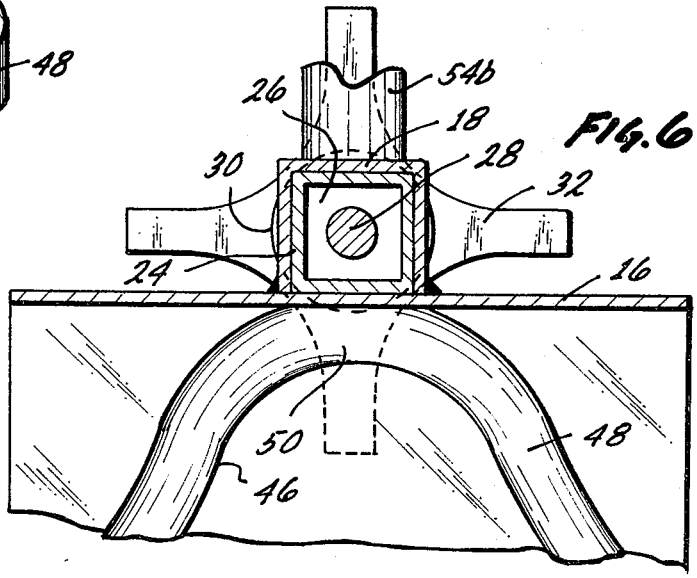
FIG. 6 is a section partly in elevation taken on the line 6—6 of FIG. 4.

The downwardly extending portion 10*a* of the angle plate 10 desirably should be stiffened by some means to prevent that portion of the plate from bending or buckling under the weight applied by the person using the rail, or even by the pressure of the clamping action of the angle plate 10 in opposition to force applied to the clamping plate 44. In the embodiment shown, the stiffening is accomplished by crimping of the plate as best shown in FIG. 5 at 46 and 48. Alternatively, actual stiffening elements (not shown) could be welded or otherwise secured to the plate in essentially the same configuration as the crimpings 46 and 48. In this connection, it should be pointed out that the stiffening elements, whether in the form of the crimpings 46, 48 or such separate elements, should be brought to a common head 50 to be secured to an orificed block 52, disposed within the closed end of the hollow member 18 to serve as the base for one leg 54*b* of a U-shaped support rail 54. This block 52 is orificed at 52*a* to permit the passage therethrough of the threaded element 28 for threading into and through the nut or threaded portion 26 within the slidable member 24. As thus internally reinforced by the block 52, the hollow member 18 may better support the base 54*a* of the forward leg 54*b* of the U-shaped rail 54. The other leg 54*c* may be welded or otherwise secured toward the after end 18*a* of the hollow member 18. A cross brace 56 may also be provided to extend between the forward leg 54*b* and the rear leg 54*c* to prevent any twisting of the U-shaped member 54 upon the application of force by the user stepping into the bathtub.

In use, the present invention may be readily mounted upon the wall 12 of a bathtub by rotating the knob 32 counterclockwise to withdraw the threaded element 28 forwardly through the threaded section 26 of the slidable member 22, to the point where the downwardly extending member 34, with its trunnion carried clamping plate 44, is so disposed beyond the inside of the tub wall 14 that the plate 34 may be brought into facing engagement with such inside wall when the corner plate 16 is mounted on the outside edge 12 of the wall 14. At this point, the knob 32 is turned clockwise, thereby to cause the threaded element 28 to move through the nut or threaded portion 26 of the inner slidable member 24, thereby drawing the latter forwardly until the plate 44 is pressed securely against the inside face of the tub wall 14, while the angle plate 10 grips the outside edge 12 of the wall, thereby producing an effective clamping of the wall 14 between the angle plate 10 and the clamping plate 44. It will be found that, through this clamping action, the U-shaped rail 54 becomes securely mounted on the tub wall 14, and will remain so until the knob 32 is again rotated counterclockwise to move the slidable member 22 rearwardly relative to the hollow member 18, thereby releasing the pressure applied by the plate 44 to the inside of the tub wall 12.

From the foregoing it may be seen that the grab rail of the present invention offers many advantages over prior art grab rails, among which are extreme simplicity in mounting without the necessity of any tools, a disposition of the rail transversely of the tub wall, effective securing of the rail, and a minimum cost of manufacture through the use of fewer parts.

I claim:

1. Gripping means mountable by means of a single torquing screw to provide hand support for a person stepping over a wall, such as the side wall of a bathtub, said means comprising:

A. a rigid angle plate, said plate having a horizontal area to be disposed on a portion of the top rim of said wall, and an area extending down along a portion of the outside of said wall below the said rim;

B. a rigid hollow member fixedly secured onto the top of the horizontal area of said plate and extending transversely of the rim of said wall said plate extending to either side of said hollow member to stabilize said hollow member relative to a tub wall, said hollow member being open at a first end distal from the downwardly extending portion of said plate, and closed at its second and opposite end except for a central orifice therethrough; said hollow member further having fixedly secured thereto a pair of upwardly extending members spaced from each other along said hollow member and fixedly joined thereabove by a continuous arcuate member lying in a plane parallel to said rigid hollow member to provide a hand grip extending transversely to a tub wall and allowing smooth uninterrupted sliding movement of a person's hand from one to another of said upwardly extending members without need to release the hand's grip during said sliding movement;

C. a slidable member configured in cross section to fit closely and slidably axially within, and relative to, said hollow member, and extending in such a manner that a first end of said slidable member projects beyond the said open first end of the hollow member, said slidable member having internal female threading extending coaxially at least partially into its second opposite end with at least a portion of the remainder of said slidable member also being hollow to permit passage therethrough of a male threaded element;

D. a male threaded element extending through the orifice in said second closed end of said hollow member, said threaded element being matingly fitted into the internal threading of said slidable member, and said threaded element terminating outside said orificed end of a single torquing handle; and E. a clamping member fixedly secured to and extending downwardly from the first end of the slidable member, said clamping member carrying plate means for facing engagement with the inside of said wall;

whereby when said rigid plate is disposed on the top rim of, and in abutment with, an upper portion of the outside of said wall, the plate means of the clamping member is disposed in facing abutment with the inside of said wall, and said torquing handle is turned to cause said threaded element to rotate in the proper direction within the female threading of said slidable member, the latter is caused to move axially into the hollow member and draw together the clamping member and its plate means tightly against the inside of the wall and in opposition to the rigid plate on the outside of the wall, thereby to provide rigid support for said hand grip.

2. The gripping means as described in claim 1 wherein said plate means is pivotable relative to the clamping member by which it is carried, thereby to enable said plate means to be pressed against the inside of the tub wall in the plane thereof.

3. The gripping means as described in claim 1 wherein said rigid plate is substantially rectangular, said hollow member is secured centrally thereto, and stiffening means are provided for said rigid plate, said stiffening means extending from the second end of said hollow member in a pair of lines diverging towards opposite lower corners of the downwardly extending area of said rigid plate.

4. The gripping means as described in claim 3 wherein said stiffening means comprise crimping in the downwardly extending area of said rigid plate.

* * * * *